US009920762B2

(12) United States Patent
Bush et al.

(10) Patent No.: US 9,920,762 B2
(45) Date of Patent: Mar. 20, 2018

(54) SCROLL COMPRESSOR WITH TILTING SLIDER BLOCK

(75) Inventors: James W. Bush, Skaneateles, NY (US); Ronald J. Duppert, Fayetteville, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 423 days.

(21) Appl. No.: 13/428,036

(22) Filed: Mar. 23, 2012

(65) Prior Publication Data

US 2013/0251577 A1 Sep. 26, 2013

(51) Int. Cl.
*F04C 23/00* (2006.01)
*F04C 29/00* (2006.01)
(Continued)

(52) U.S. Cl.
CPC ..... *F04C 23/008* (2013.01); *F04C 18/0215* (2013.01); *F04C 29/0057* (2013.01); *F01C 17/066* (2013.01); *F01C 21/007* (2013.01); *F04C 29/126* (2013.01); *F04C 2230/603* (2013.01); *F04C 2240/56* (2013.01); *F04C 2240/60* (2013.01); *Y10T 29/4924* (2015.01)

(58) Field of Classification Search
CPC .. F01C 17/066; F01C 21/007; F04C 18/0215; F04C 2230/603; F04C 2240/56; F04C 2240/60; F04C 23/008; F04C 29/0057; F04C 29/126; Y10T 29/4924
USPC ..... 418/55.5, 57, 55.1
See application file for complete search history.

(56) References Cited

U.S. PATENT DOCUMENTS 35,216 A 5/1862 Carton
5,222,881 A * 6/1993 Sano et al. ..... 418/55.1
(Continued)

FOREIGN PATENT DOCUMENTS

EP 0732503 A1 9/1996
EP 1983196 A1 10/2008

OTHER PUBLICATIONS

Dynamics of Compliance Mechanisms Scroll Compressors, Part II: Radial Compliance. J.J. Nieter, United Technologies Research Center, International Compressor Engineering Conference. Cover + pp. 317-376, Paper 720, 1990.*
(Continued)

*Primary Examiner* — Mark Laurenzi
*Assistant Examiner* — Paul Thiede
(74) *Attorney, Agent, or Firm* — Reinhart Boerner Van Deuren P.C.

(57) ABSTRACT

A scroll compressor that includes a housing and scroll compressor bodies disposed in the housing. The scroll bodies include a first scroll body and a second scroll body. The first and second scroll bodies have respective bases and respective scroll ribs that project from the respective bases. Further, the scroll ribs mutually engage such that the second scroll body is movable relative to the first scroll body to compress fluid. A drive shaft has an eccentric drive pin configured to engage a drive hub on the second scroll body. The scroll compress also includes a slider block that fits over the drive pin. The slider block has a first drive surface configured to engage a second drive surface of the drive pin. In particular embodiments, the slider block can tilt about one or more edges of the second drive surface when the drive shaft is deflected under load.

21 Claims, 12 Drawing Sheets

(51) Int. Cl.

| | |
|---|---|
| ***F04C 18/02*** | (2006.01) |
| ***F01C 17/06*** | (2006.01) |
| ***F01C 21/00*** | (2006.01) |
| ***F04C 29/12*** | (2006.01) |

(56) References Cited

U.S. PATENT DOCUMENTS

| | | | | |
|---|---|---|---|---|
| 5,342,185 | A | 8/1994 | Anderson | |
| 5,366,359 | A * | 11/1994 | Bookbinder et al. | 418/55.5 |
| 5,407,335 | A | 4/1995 | Caillat et al. | |
| 5,427,511 | A | 6/1995 | Caillat et al. | |
| 5,482,450 | A | 1/1996 | Caillat et al. | |
| 5,496,157 | A | 3/1996 | Shoulders et al. | |
| 5,580,230 | A | 12/1996 | Keifer et al. | |
| 5,897,306 | A | 4/1999 | Beck | |
| 6,053,714 | A * | 4/2000 | Fenocchi et al. | 418/55.1 |
| 6,089,840 | A * | 7/2000 | Iizuka et al. | 418/55.5 |
| 6,179,592 | B1 * | 1/2001 | Hugenroth et al. | 418/55.5 |
| 6,267,573 | B1 * | 7/2001 | Fenocchi et al. | 418/55.5 |
| 6,293,767 | B1 | 9/2001 | Bass | |
| 6,398,530 | B1 | 6/2002 | Hasemann | |
| 6,471,499 | B1 * | 10/2002 | Sun | 418/55.5 |
| 6,560,868 | B2 | 5/2003 | Milliff et al. | |
| 6,585,502 | B2 | 7/2003 | Fenocchi | |
| 6,648,616 | B2 | 11/2003 | Patel et al. | |
| 6,761,541 | B1 | 6/2004 | Clendenin | |
| 6,814,551 | B2 | 11/2004 | Kammhoff et al. | |
| 6,893,236 | B2 * | 5/2005 | Jeong | 418/55.5 |
| 6,960,070 | B2 | 11/2005 | Kammhoff et al. | |
| 7,070,401 | B2 | 7/2006 | Clendenin et al. | |
| 7,104,771 | B2 * | 9/2006 | Choi et al. | 418/55.5 |
| 7,112,046 | B2 | 9/2006 | Kammhoff et al. | |
| 7,150,609 | B2 * | 12/2006 | Kiem et al. | 418/55.5 |
| 7,273,361 | B2 * | 9/2007 | Park | 418/55.1 |
| 7,273,362 | B2 | 9/2007 | Patel et al. | |
| 7,273,363 | B1 * | 9/2007 | Sun et al. | 418/55.5 |
| 7,476,092 | B1 | 1/2009 | Bush | |
| 7,819,638 | B2 | 10/2010 | Grimm et al. | |
| 8,002,528 | B2 | 8/2011 | Hodapp et al. | |
| 2003/0039569 | A1 | 2/2003 | Lee et al. | |
| 2010/0239447 | A1 | 9/2010 | Bush | |

OTHER PUBLICATIONS

U.S. Appl. No. 13/427,984, filed Mar. 23, 2012, Cullen et al.
U.S. Appl. No. 13/427,991, filed Mar. 23, 2012, Rogalski.
U.S. Appl. No. 13/427,992, filed Mar. 23, 2012, Bessel et al.
U.S. Appl. No. 13/428,036, filed Mar. 23, 2012, Bush et al.
U.S. Appl. No. 13/428,165, filed Mar. 23, 2012, Heusler.
U.S. Appl. No. 13/428,172, filed Mar. 23, 2012, Roof et al.
U.S. Appl. No. 13/428,173, filed Mar. 23, 2012, Bush.
U.S. Appl. No. 13/428,026, filed Mar. 23, 2012, Roof.
U.S. Appl. No. 13/428,042, filed Mar. 23, 2012, Roof et al.
U.S. Appl. No. 13/428,072, filed Mar. 23, 2012, Wang et al.
U.S. Appl. No. 13/428,337, filed Mar. 23, 2012, Duppert et al.
U.S. Appl. No. 13/428,406, filed Mar. 23, 2012, Duppert.
U.S. Appl. No. 13/428,407, filed Mar. 23, 2012, Duppert et al.
U.S. Appl. No. 13/428,505, filed Mar. 23, 2012, Duppert et al.

* cited by examiner

SCROLL COMPRESSOR WITH TILTING SLIDER BLOCK

FIELD OF THE INVENTION

The present invention generally relates to scroll compressors for compressing refrigerant, and more particularly to an apparatus to reduce edge loading of the drive bearing in a scroll compressor.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 5,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors assemblies conventionally include an outer housing having a scroll compressor contained therein. A scroll compressor includes first and second scroll compressor members. A first compressor member is typically arranged stationary and fixed in the outer housing. A second scroll compressor member is movable relative to the first scroll compressor member in order to compress refrigerant between respective scroll ribs which rise above the respective bases and engage in one another. Conventionally the movable scroll compressor member is driven about an orbital path about a central axis for the purposes of compressing refrigerant. An appropriate drive unit, typically an electric motor, is provided usually within the same housing to drive the movable scroll member.

Embodiments of the invention described hereinbelow represent an advancement over the state of the art with respect to scroll compressors. These and other advantages of the invention, as well as additional inventive features, will be apparent from the description of the invention provided herein.

BRIEF SUMMARY OF THE INVENTION

Typically, scroll compressors using "slider block radial compliance" rely on an eccentric bearing (the slider block) which is separate from the eccentric drive shaft. The bearing fits over an eccentric pin on the end of the shaft and is engaged through a drive surface which allows the bearing to move radially while being driven rotationally by the shaft. In some instances, due to the cantilevered nature of the drive bearing, shaft deflections under load can result in misalignment of the drive bearing causing edge loading. The deflection of the shaft is transferred to the slider block through the drive surface.

In one aspect, embodiments of the invention provide a scroll compressor that includes a housing and scroll compressor bodies disposed in the housing. The scroll bodies include a first scroll body and a second scroll body. The first and second scroll bodies have respective bases and respective scroll ribs that project from the respective bases. Further, the scroll ribs mutually engage, wherein the second scroll body is movable relative to the first scroll body to compress fluid. A drive unit is configured to rotate a drive shaft to drive the second scroll body in an orbital path. The drive shaft has an eccentric drive pin configured to engage a drive hub on the second scroll body. The scroll compressor further includes a slider block that fits over the drive pin and provides radial compliance of the first scroll body. The slider block has a first drive surface configured to engage a second drive surface of the drive pin. In particular embodiments of the invention, the second drive surface is shorter than the overall length of the drive pin, such that the slider block can tilt about one or more edges of the second drive surface when the drive shaft is deflected under load.

In alternate embodiments of the invention, the first drive surface of the slider block, rather than the second drive surface, is a raised surface that is shorter than the overall length of the drive pin. In this embodiment, the slider block is able to tilt about one or more edges of the first drive surface when the drive shaft is deflected under load to provide improved radial compliance for the movable scroll body.

In a particular embodiment, the second drive surface is raised with respect to an exterior surface portion of the drive pin. In a more particular embodiment, the second drive surface is generally rectangular with a substantially flat outer surface. In an even more particular embodiment, the length of the second drive surface is 25% to 50% of the overall drive pin length. In an alternate embodiment in which the first drive surface is the raised, surface, the length of the first drive surface is 25% to 75% of the overall drive pin length.

In a further embodiment, the slider block includes a cylindrical exterior surface and an opening defined by an interior surface, the interior being having two rounded portions and two flat portions. In a certain embodiment, the two flat portions comprise a first flat portion and a second flat portion, the first flat portion being longer than the second flat portion. In a more particular embodiment, the first flat portion abuts a flat portion of the drive pin. In an even more particular embodiment, the second flat portion functions to keep the slider block in the correct position with respect to the drive pin.

In another aspect, embodiments of the invention provide a method of providing radial compliance for the first scroll body in a scroll compressor. The method includes configuring a slider block to assemble onto a drive pin eccentrically located at one end of a drive shaft. The drive pin has an exterior raised drive surface to engage a drive surface of the slider block. In a particular embodiment, the raised drive surface has a shorter length than the overall length of the drive pin, such that the slider block can tilt back and forth on respective edges of the raised drive surface where these edges engage the slider block. The method also includes assembling the slider block onto the drive pin, and assembling a movable scroll member onto the slider block. In certain embodiments, the movable scroll member has a cylindrical hub configured to receive the slider block.

In a particular embodiment of the method, assembling the slider block to the drive pin comprises assembling a first flat portion of an interior surface of the slider block to a corresponding flat portion of the drive pin. In a more particular embodiment, assembling the slider block to the drive pin further comprises assembling a slider block having a second flat portion configured to keep the slider block in the correct position with respect to the drive pin.

In a particular embodiment, the method further includes assembling a sleeve between the slider block and the cylindrical hub of the movable scroll member. In a further embodiment, the slider block includes a chamfered surface that extends axially from one end of the slider block, the chamfered surface having one or more notched openings to prevent the trapping of gas beneath the slider block.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

DETAILED DESCRIPTION OF THE INVENTION

Figure 1:
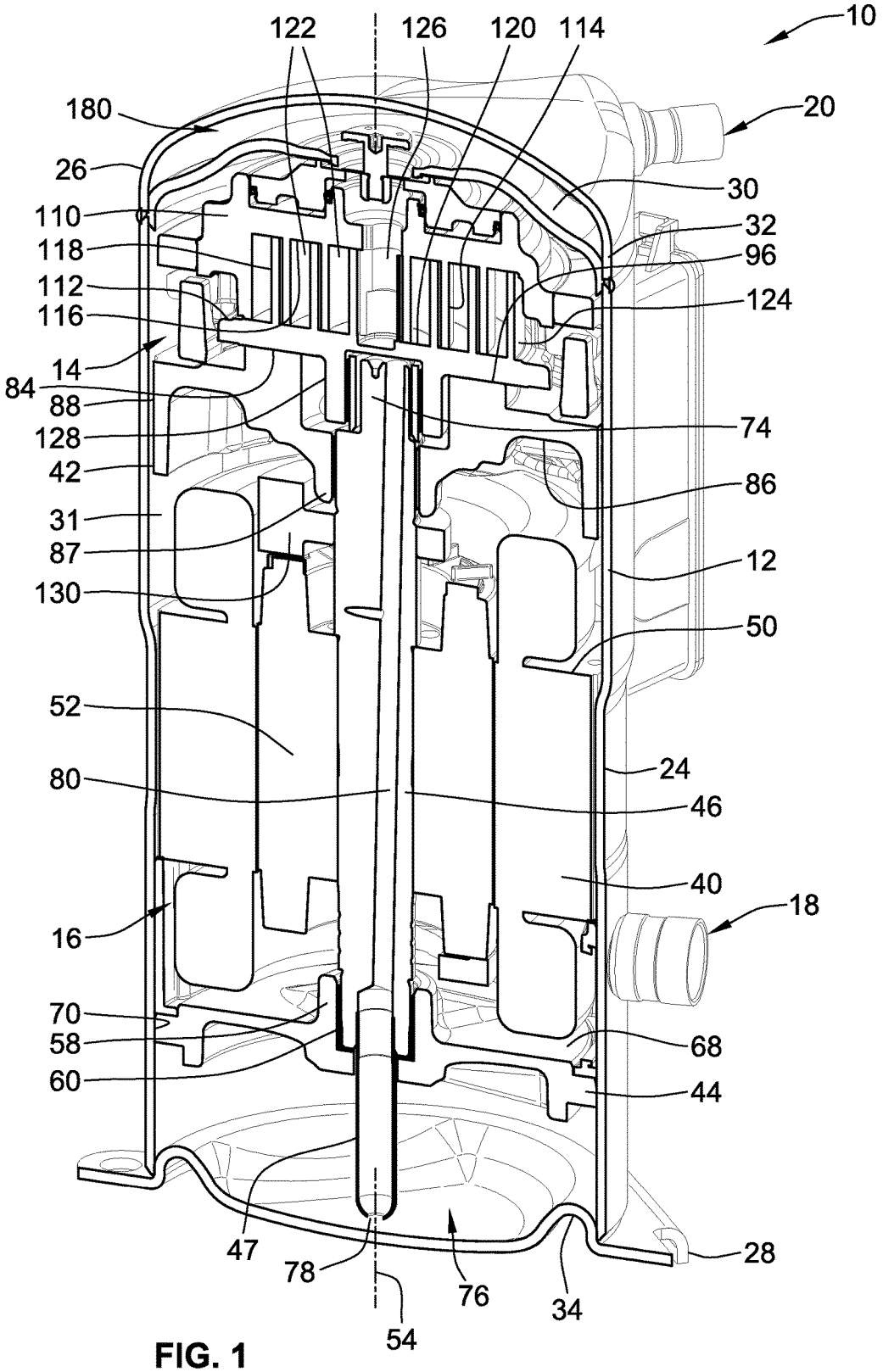
FIG. 1 is a cross-sectional isometric view of a scroll compressor assembly, according to an embodiment of the invention.

An embodiment of the present invention is illustrated in the figures as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12.

Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via a spacer, or adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearings 42, 44. Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction parallel to the central axis 54, while the terms "radial' or "radially-extending" indicates a feature that projects or extends in a direction perpendicular to the central axis 54.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

In the embodiment of FIG. 1, the drive shaft 46 has an impeller tube 47 attached at the bottom end of the drive shaft 46. In a particular embodiment, the impeller tube 47 is of a smaller diameter than the drive shaft 46, and is aligned concentrically with the central axis 54. As can be seen from FIG. 1, the drive shaft 46 and impeller tube 47 pass through an opening in the cylindrical hub 58 of the lower bearing member 44. At its upper end, the drive shaft 46 is journaled for rotation within the upper bearing member 42. Upper bearing member 42 may also be referred to as a "crankcase".

The drive shaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
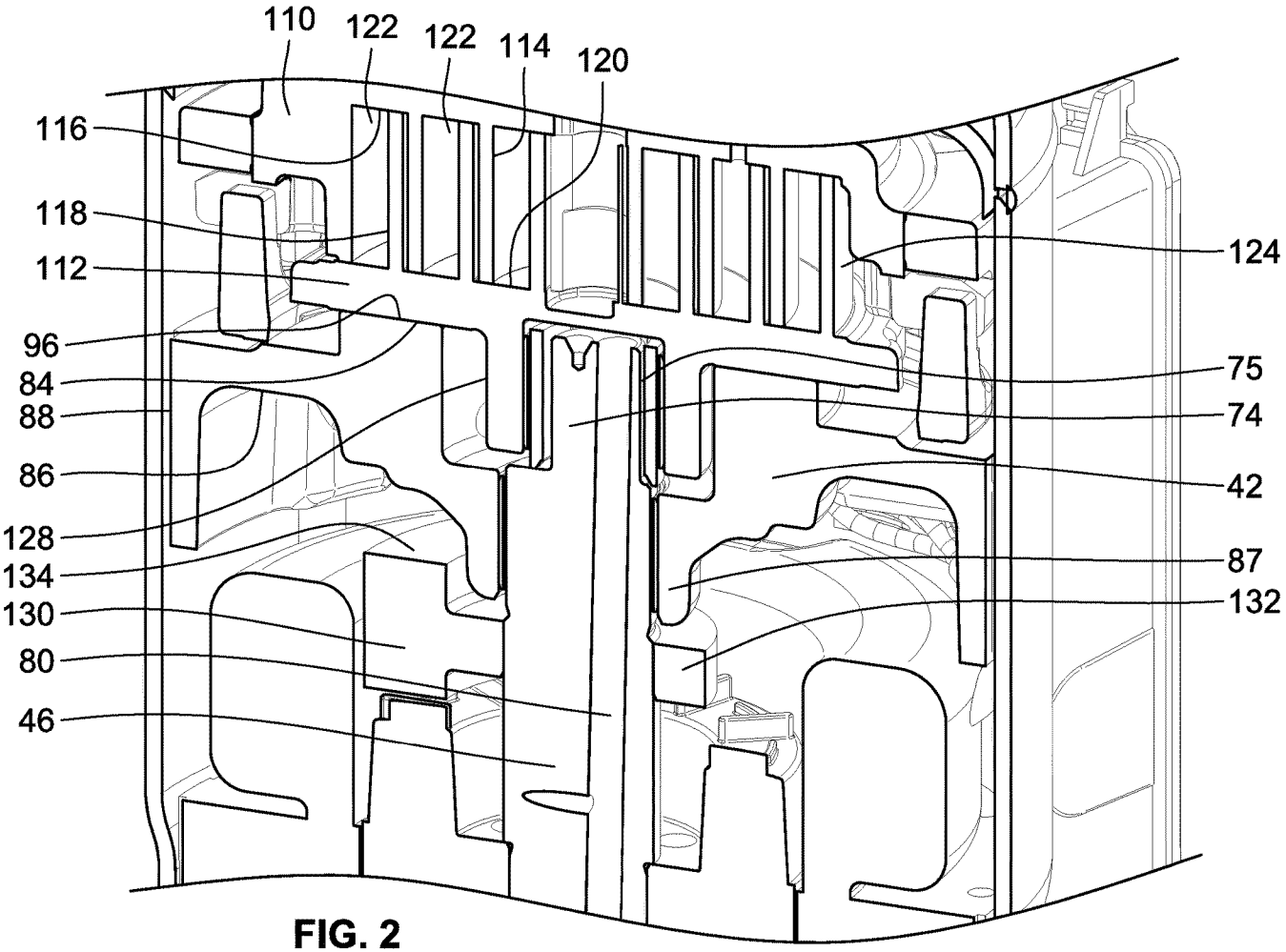
FIG. 2 is a cross-sectional isometric view of an upper portion of the scroll compressor assembly of FIG. 1.
Figure 3:
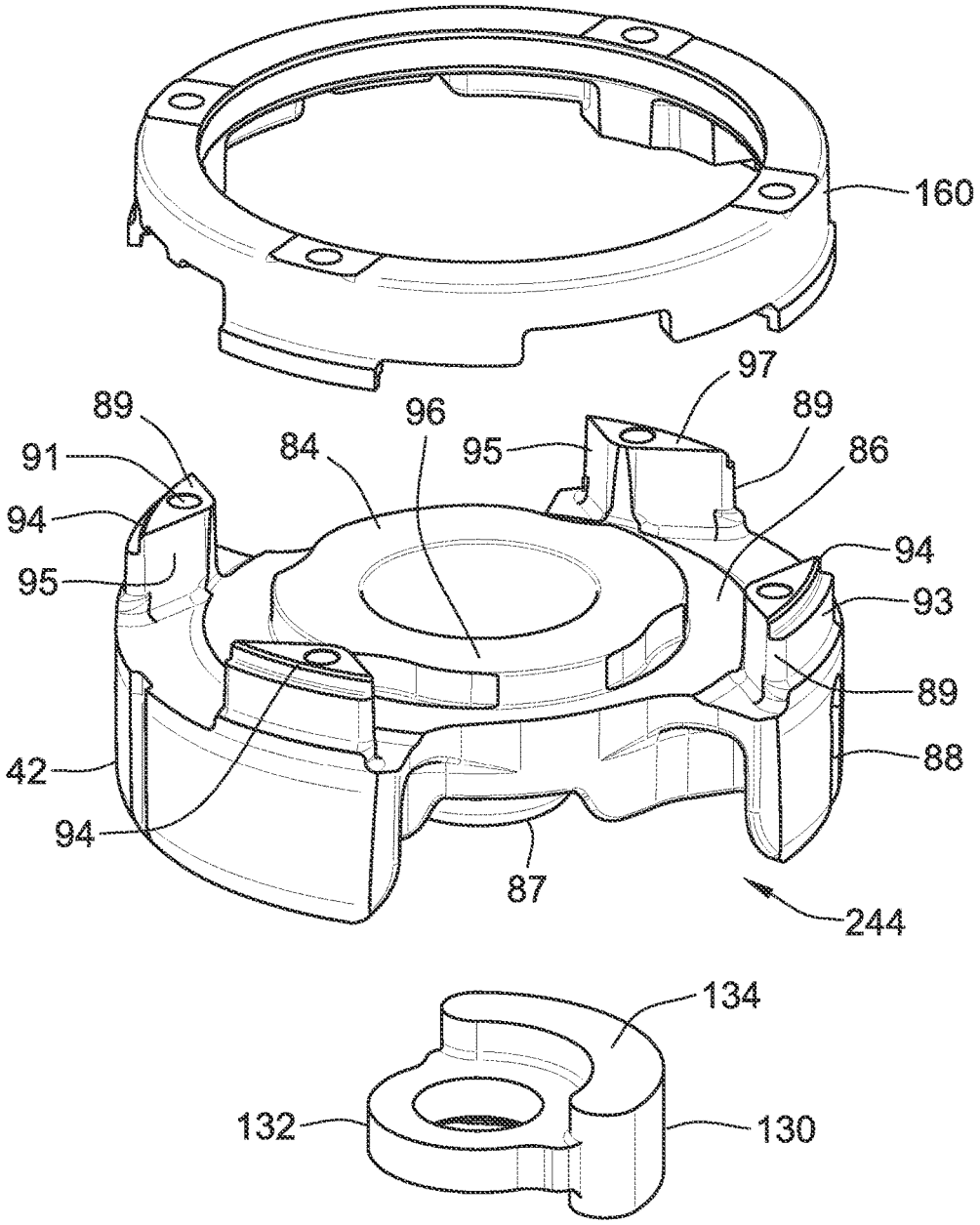
FIG. 3 is an exploded isometric view of selected components of the scroll compressor assembly of FIG. 1.

As shown in FIGS. 2 and 3, the upper bearing member, or crankcase, 42 includes a central bearing hub 87 into which the drive shaft 46 is journaled for rotation, and a thrust bearing 84 that supports the movable scroll compressor body 112. (See also FIG. 9). Extending outward from the central bearing hub 87 is a disk-like portion 86 that terminates in an intermittent perimeter support surface 88 defined by discretely spaced posts 89. In the embodiment of FIG. 3, the central bearing hub 87 extends below the disk-like portion 86, while the thrust bearing 84 extends above the disk-like portion 86. In certain embodiments, the intermittent perimeter support surface 88 is adapted to have an interference and press-fit with the outer housing 12. In the embodiment of FIG. 3, the crankcase 42 includes four posts 89, each post having an opening 91 configured to receive a threaded fastener. It is understood that alternate embodiments of the invention may include a crankcase with more or less than four posts, or the posts may be separate components altogether. Alternate embodiments of the invention also include those in which the posts are integral with the pilot ring instead of the crankcase.

In certain embodiments such as the one shown in FIG. 3, each post 89 has an arcuate outer surface 93 spaced radially inward from the inner surface of the outer housing 12, angled interior surfaces 95, and a generally flat top surface 97 which can support a pilot ring 160. In this embodiment, intermittent perimeter support surface 88 abut the inner surface of the outer housing 12. Further, each post 89 has a chamfered edge 94 on a top, outer portion of the post 89. In particular embodiments, the crankcase 42 includes a plurality of spaces 244 between adjacent posts 89. In the embodiment shown, these spaces 244 are generally concave and the portion of the crankcase 42 bounded by these spaces 244 will not contact the inner surface of the outer housing 12.

Figure 8:
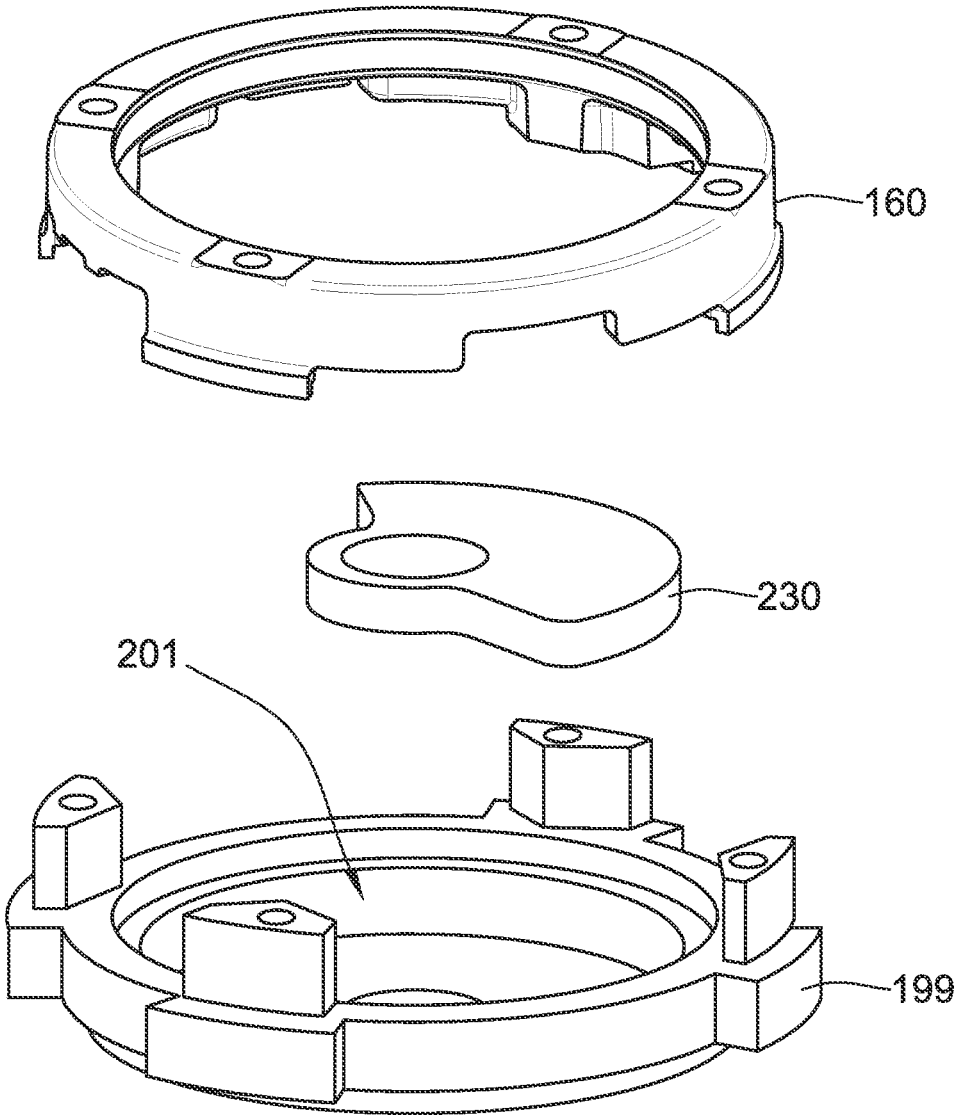
FIG. 8 is an exploded isometric view of selected components for an alternate embodiment of the scroll compressor assembly.
Figure 9:
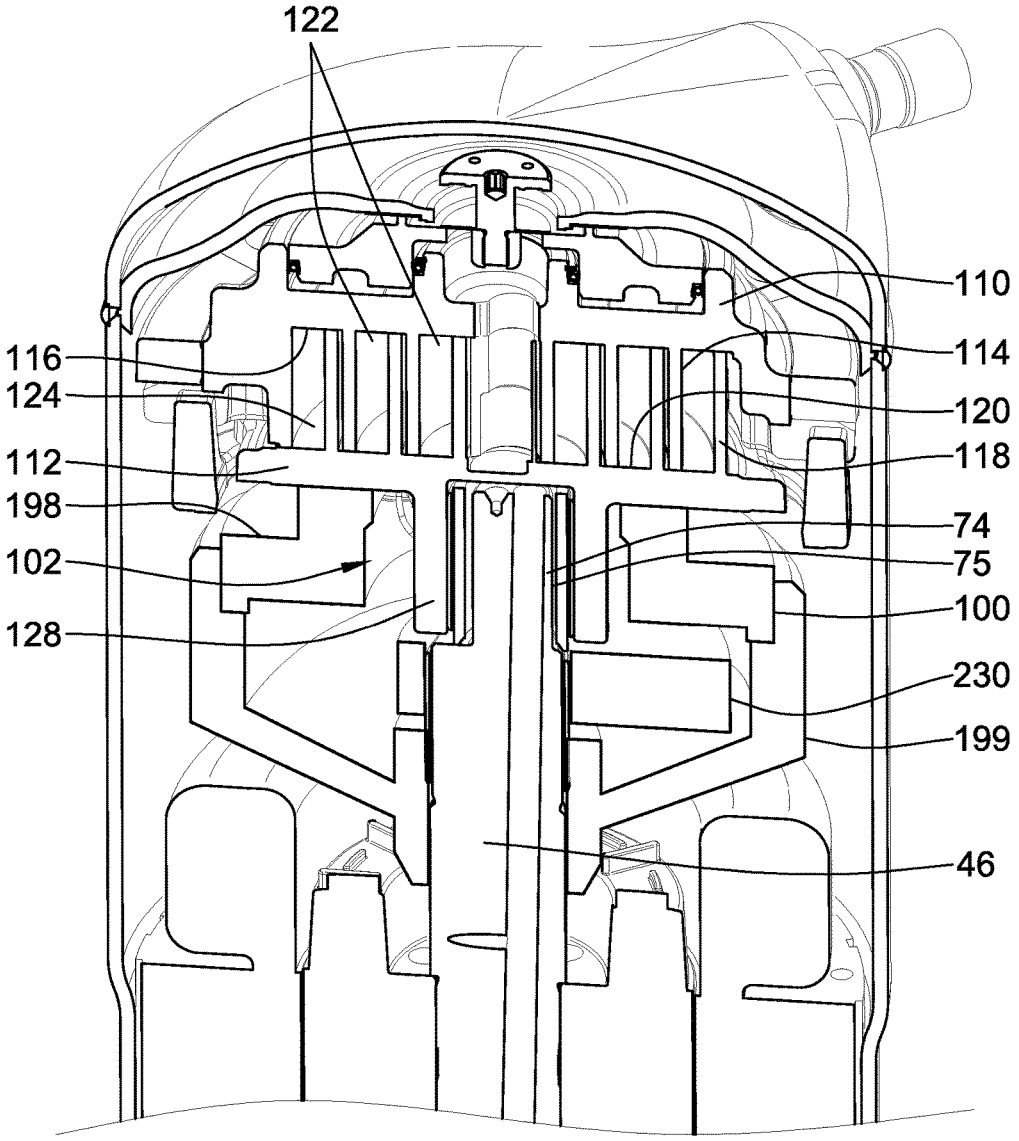
FIG. 9 is a cross-sectional isometric view of a portion of a scroll compressor assembly, constructed in accordance with an embodiment of the invention.

The upper bearing member or crankcase 42 also provides axial thrust support to the movable scroll compressor body 112 through a bearing support via an axial thrust surface 96 of the thrust bearing 84. While, as shown FIGS. 1-3, the crankcase 42 may be integrally provided by a single unitary component, FIGS. 8 and 9 show an alternate embodiment in which the axial thrust support is provided by a separate collar member 198 that is assembled and concentrically located within the upper portion of the upper bearing member 199 along stepped annular interface 100. The collar member 198 defines a central opening 102 that is a size large enough to clear a cylindrical bushing drive hub 128 of the movable scroll compressor body 112 in addition to the eccentric offset drive section 74, and allow for orbital eccentric movement thereof.

Turning in greater detail to the scroll compressor 14, the scroll compressor includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective base surfaces 120, 116 of the other respective scroll compressor body 112, 110.

As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 1-2). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the drive shaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the drive shaft 46 about the central axis 54. Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 (see counterweight 130 shown best in FIGS. 2 and 3) that provides for the counterweight effect and thereby balancing of the overall weight of the components rotating about the central axis 54. This provides for reduced vibration and noise of the overall assembly by internally balancing or cancelling out inertial forces.

With reference to FIGS. 4-7, the upper side (e.g. the side opposite the scroll rib) of the fixed scroll 110 supports a floating seal 170 above which is disposed the separator plate 30. In the embodiment shown, to accommodate the floating seal 170, the upper side of the fixed scroll compressor body 110 includes an annular and, more specifically, the cylindrical inner hub region 172, and the peripheral rim 174 spaced radially outward from the inner hub region 172. The inner hub region 172 and the peripheral rim 174 are connected by a radially-extending disc region 176 of the base 116. As shown in FIG. 11, the underside of the floating seal 170 has circular cutout adapted to accommodate the inner hub region 172 of the fixed scroll compressor body 110. Further, as can be seen from FIGS. 4 and 5, the perimeter wall 173 of the floating seal is adapted to fit somewhat snugly inside the peripheral rim 174. In this manner, the fixed scroll compressor body 110 centers and holds the floating seal 170 with respect to the central axis 54.

Figure 4:
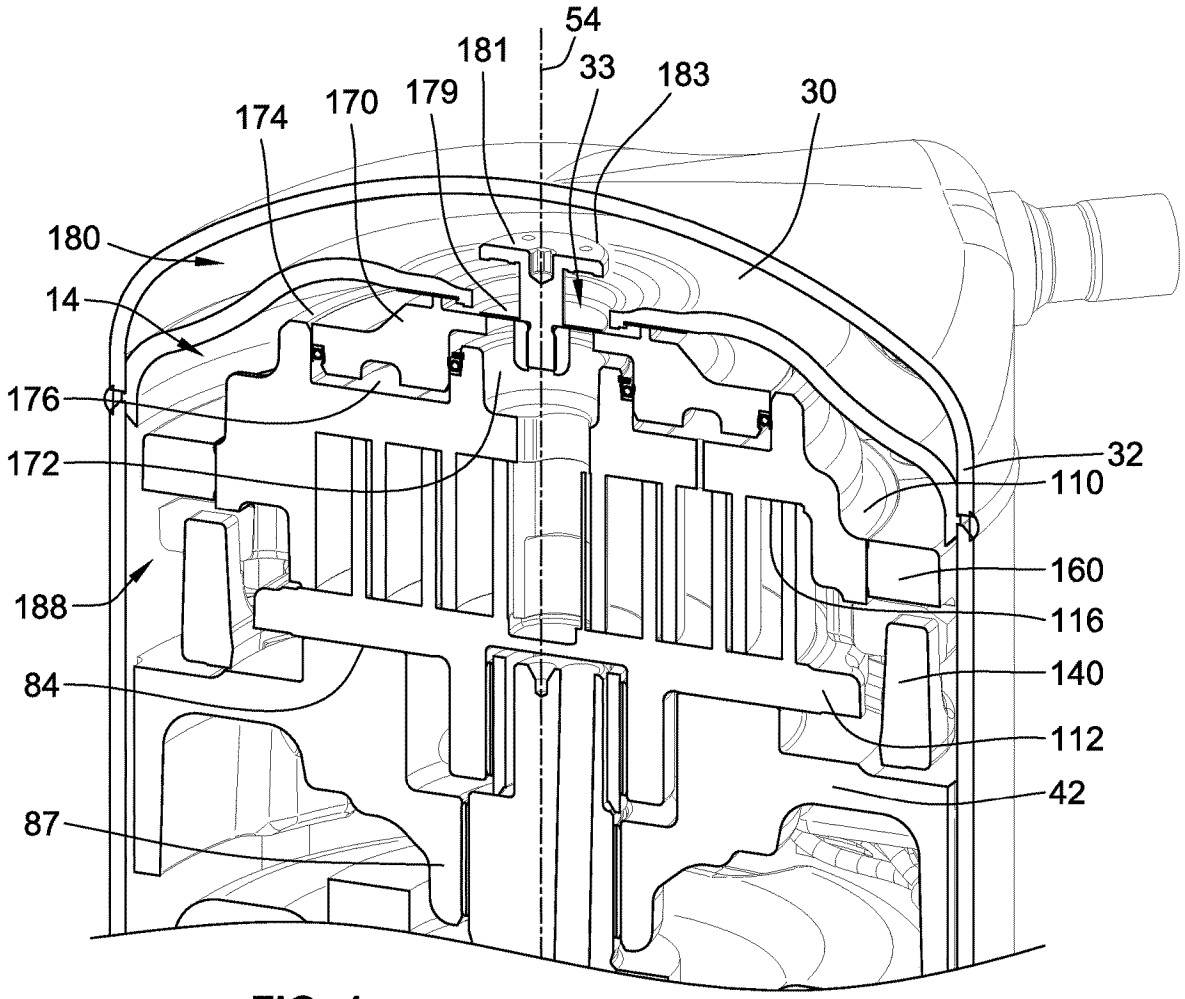
FIG. 4 is a cross-sectional isometric view of the components in the top end section of the outer housing, according to an embodiment of the invention.
Figure 5:
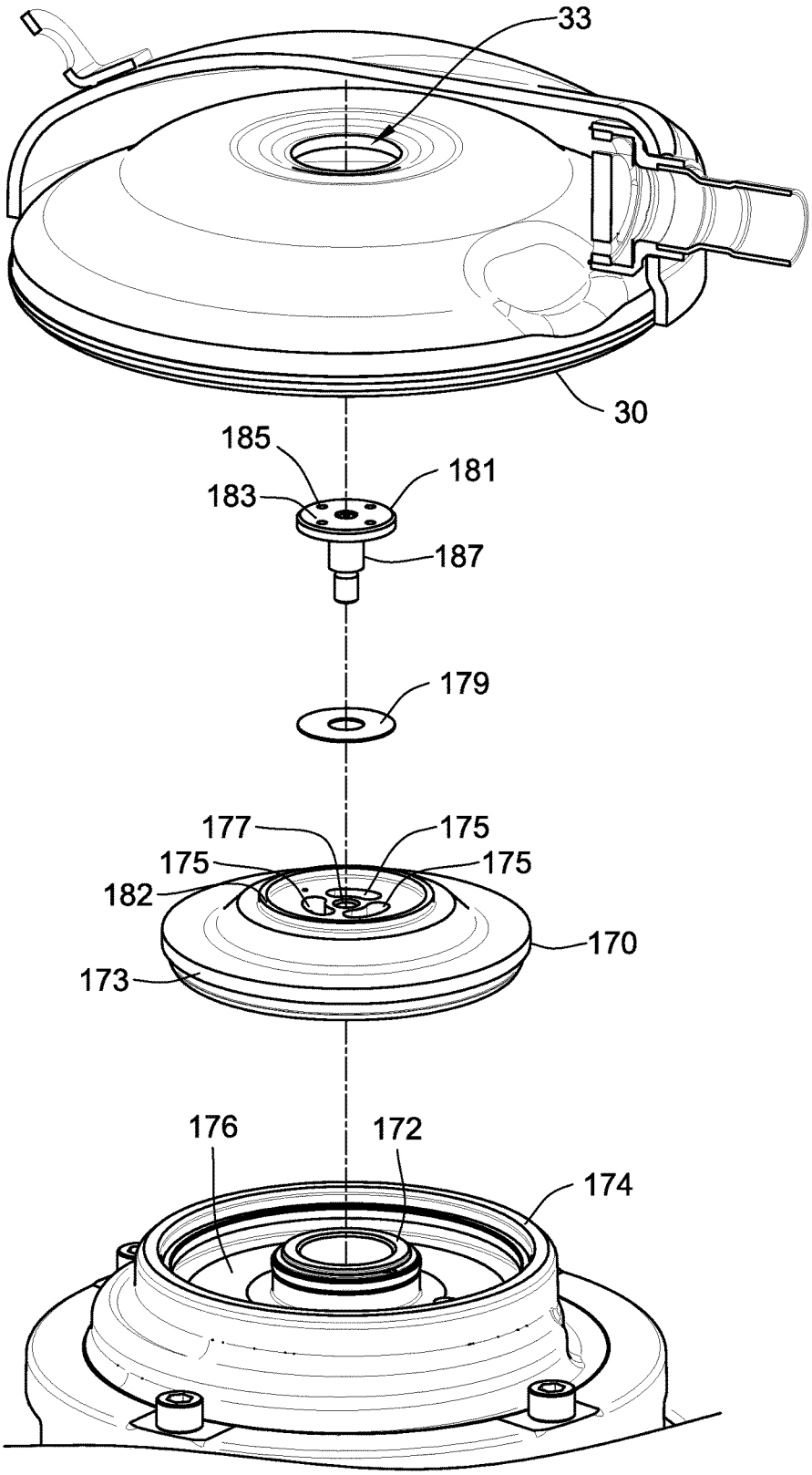
FIG. 5 is an exploded isometric view of the components of FIG. 4.
Figure 6:
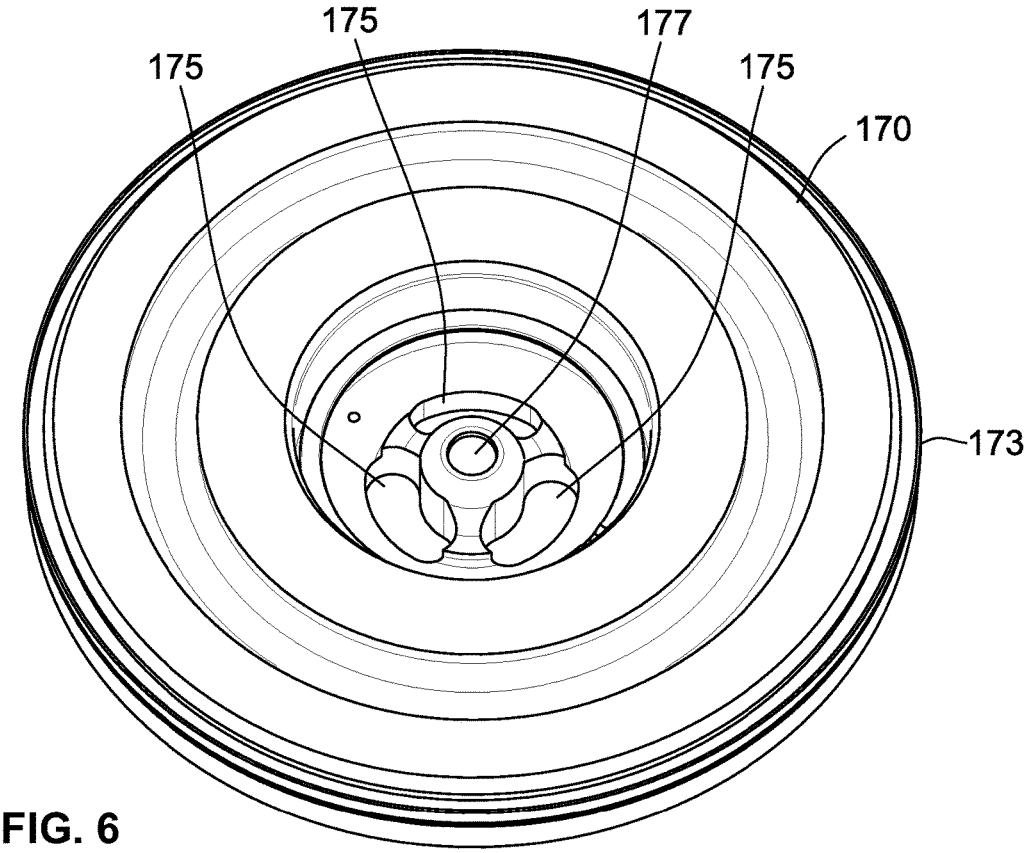
FIG. 6 is a bottom isometric view of the floating seal, according to an embodiment of the invention.
Figure 7:
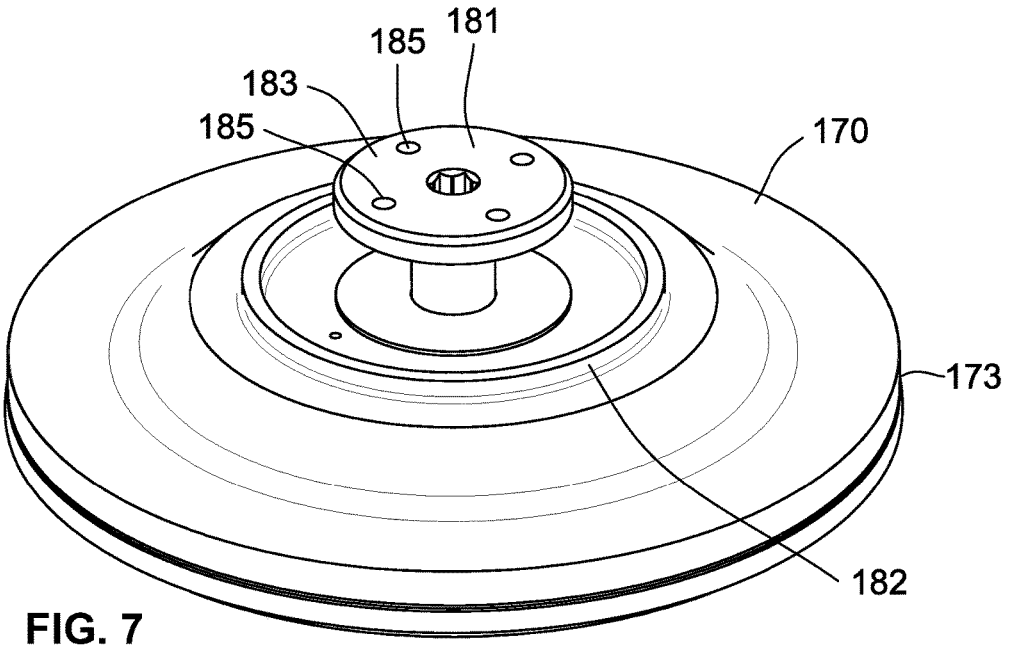
FIG. 7 is a top isometric view of the floating seal of FIG. 6.

In a particular embodiment of the invention, a central region of the floating seal 170 includes a plurality of openings 175. In the embodiment shown, one of the plurality of openings 175 is centered on the central axis 54. That central opening 177 is adapted to receive a rod 181 which is affixed to the floating seal 170. As shown in FIGS. 9 through 12, a ring valve 179 is assembled to the floating seal 170 such that the ring valve 179 covers the plurality of openings 175 in the floating seal 170, except for the central opening 177 through which the rod 181 is inserted. The rod 181 includes an upper flange 183 with a plurality of openings 185 therethrough, and a stem 187. As can be seen in FIG. 4, the separator plate 30 has a center hole 33. The upper flange 183 of rod 181 is adapted to pass through the center hole 33, while the stem 187 is inserted through central opening 177. The ring valve 179 slides up and down the rod 181 as needed to prevent back flow from a high-pressure chamber 180. With this arrangement, the combination of the separator plate 30 and the fixed scroll compressor body 110 serve to separate the high pressure chamber 180 from a lower pressure region 188 within the outer housing 12. Rod 181 guides and limits the motion of the ring valve 179. While the separator plate 30 is shown as engaging and constrained radially within the cylindrical side wall region 32 of the top end housing section 26, the separator plate 30 could alternatively be cylindrically located and axially supported by some portion or component of the scroll compressor 14.

In certain embodiments, when the floating seal 170 is installed in the space between the inner hub region 172 and the peripheral rim 174, the space beneath the floating seal 170 is pressurized by a vent hole (not shown) drilled through the fixed scroll compressor body 110 to chamber 122 (shown in FIG. 2). This pushes the floating seal 170 up against the separator plate 30 (shown in FIG. 4). A circular rib 182 presses against the underside of the separator plate 30 forming a seal between high-pressure discharge gas and low-pressure suction gas.

While the separator plate 30 could be a stamped steel component, it could also be constructed as a cast and/or machined member (and may be made from steel or aluminum) to provide the ability and structural features necessary to operate in proximity to the high-pressure refrigerant gases output by the scroll compressor 14. By casting or machining the separator plate 30 in this manner, heavy stamping of such components can be avoided.

During operation, the scroll compressor assembly 10 is operable to receive low-pressure refrigerant at the housing inlet port 18 and compress the refrigerant for delivery to the high-pressure chamber 180 where it can be output through the housing outlet port 20. This allows the low-pressure refrigerant to flow across the electrical motor assembly 40 and thereby cool and carry away from the electrical motor assembly 40 heat which can be generated by operation of the motor. Low-pressure refrigerant can then pass longitudinally through the electrical motor assembly 40, around and through void spaces therein toward the scroll compressor 14. The low-pressure refrigerant fills the chamber 31 formed between the electrical motor assembly 40 and the outer housing 12. From the chamber 31, the low-pressure refrigerant can pass through the upper bearing member or crankcase 42 through the plurality of spaces 244 that are defined by recesses around the circumference of the crankcase 42 in order to create gaps between the crankcase 42 and the outer housing 12. The plurality of spaces 244 may be angularly spaced relative to the circumference of the crankcase 42.

After passing through the plurality of spaces 244 in the crankcase 42, the low-pressure refrigerant then enters the intake area 124 between the fixed and movable scroll compressor bodies 110, 112. From the intake area 124, the low-pressure refrigerant enters between the scroll ribs 114, 118 on opposite sides (one intake on each side of the fixed scroll compressor body 110) and is progressively compressed through chambers 122 until the refrigerant reaches its maximum compressed state at the compression outlet 126 from which it subsequently passes through the floating seal 170 via the plurality of openings 175 and into the high-pressure chamber 180. From this high-pressure chamber 180, high-pressure compressed refrigerant then flows from the scroll compressor assembly 10 through the housing outlet port 20.

FIGS. 8 and 9 illustrate an alternate embodiment of the invention. Instead of a crankcase 42 formed as a single piece, FIGS. 8 and 9 show an upper bearing member or crankcase 199 combined with a separate collar member 198, which provides axial thrust support for the scroll compressor 14. In a particular embodiment, the collar member 198 is assembled into the upper portion of the upper bearing member or crankcase 199 along stepped annular interface 100. Having a separate collar member 198 allows for a counterweight 230 to be assembled within the crankcase 199, which is attached to the pilot ring 160. This allows for a more compact assembly than described in the previous embodiment where the counterweight 130 was located outside of the crankcase 42.

As is evident from the exploded view of FIG. 8 and as stated above, the pilot ring 160 can be attached to the upper bearing member or crankcase 199 via a plurality of threaded fasteners to the upper bearing member 199 in the same manner that it was attached to crankcase 42 in the previous embodiment. The flattened profile of the counterweight 230 allows for it to be nested within an interior portion 201 of the upper bearing member 199 without interfering with the collar member 198, the key coupling 140, or the movable scroll compressor body 112.

Figure 10A:
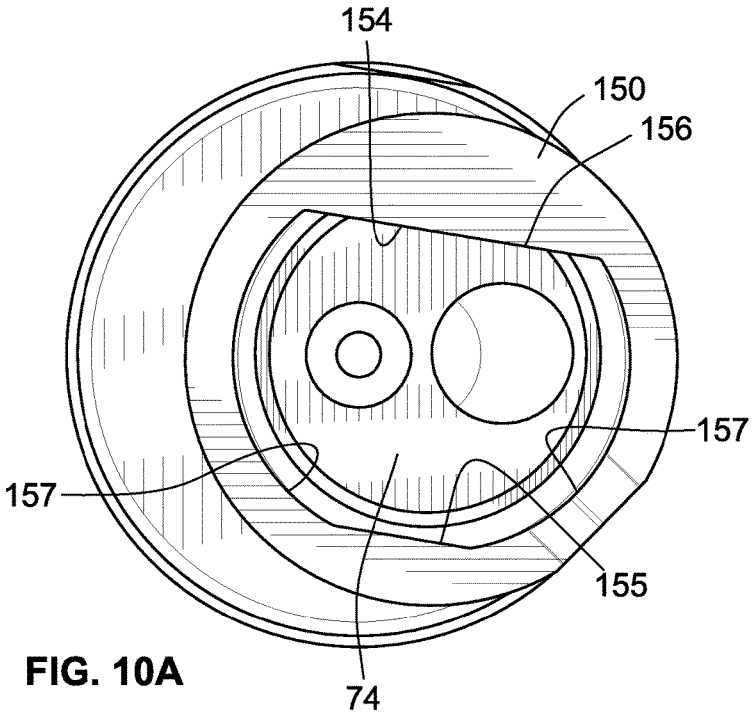
FIG. 10A is an end view of a scroll compressor drive shaft with offset eccentric drive section and slider block assembled thereto, in accordance with an embodiment of the invention.
Figure 10B:
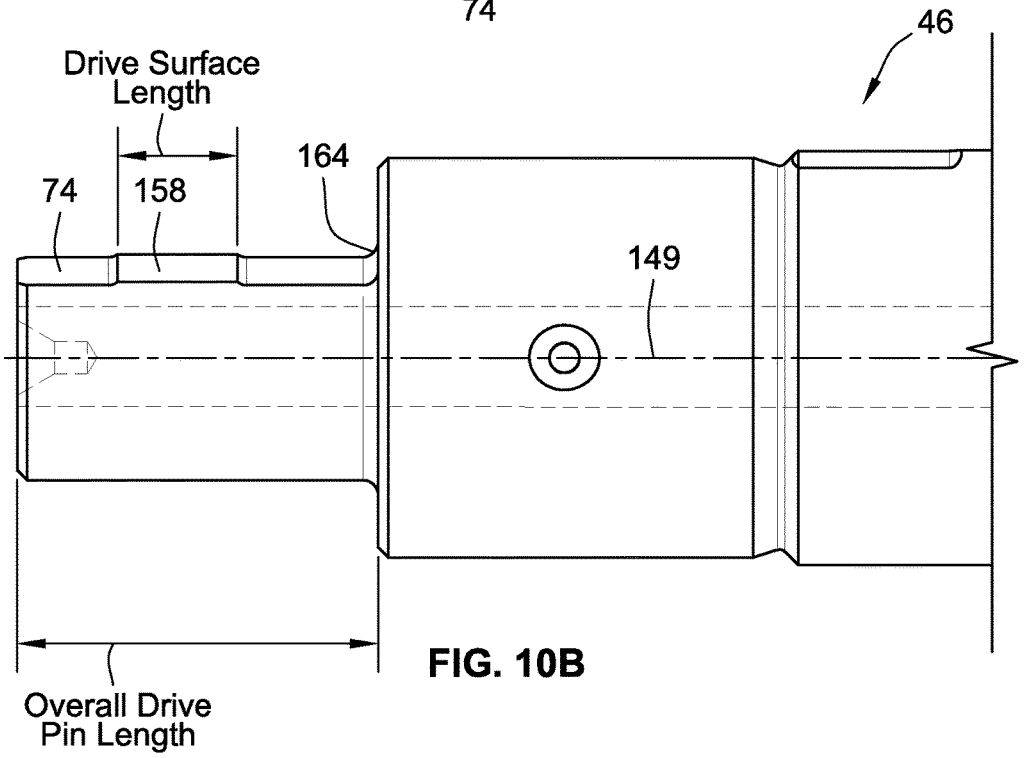
FIG. 10B is a side view of a scroll compressor drive shaft having an offset eccentric drive section, or drive pin, constructed in accordance with an embodiment of the invention.
Figure 11B:
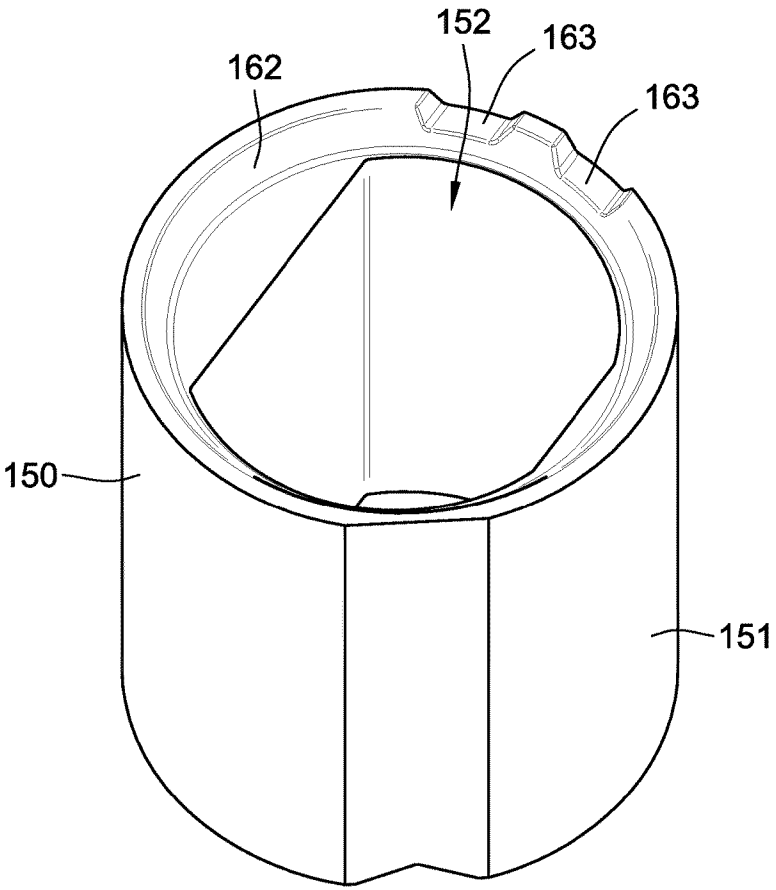
FIGS. 11A, 11B, and 11C illustrate isometric views of the slider block, according to embodiments of the invention.
Figure 11A:
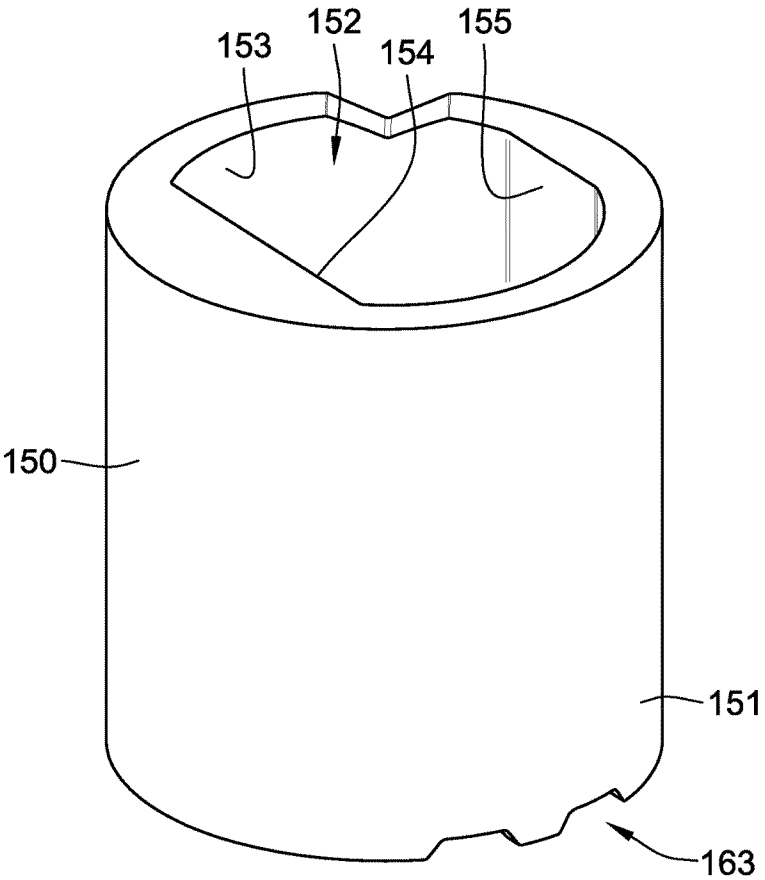

FIGS. 10A and 10B show end and side views of scroll compressor drive shaft 46 having an offset eccentric drive section 74 (also referred to herein as the drive pin) and a longitudinal axis 149, in accordance with an embodiment of the invention. However, only the end view shows a slider block 150 assembled onto the offset eccentric drive section or drive pin 74. FIGS. 11A and 11B provide a perspective views of the slider block 150, according to an embodiment of the invention. FIG. 11B shows a bottom view of the slider block 150 of FIG. 11A. In this embodiment, the slider block 150 is cylindrical having an exterior surface 151 and an opening 152 therethrough, the opening 152 defined by an interior surface 153. This exterior surface 151 of the slider block 150 forms the drive bearing and carries the running load of the scroll compressor 14. FIG. 11B shows an embodiment in which the slider block 150 has a chamfered end portion 162 that extends axially from an end of the slider block 150, or upward as viewed in the orientation shown in FIG. 11B. The chamfered end portion 162 provides clearance for the radius 164 (see FIGS. 10B and 12) that is located at the base of the D-shaped drive pin 74 on the drive shaft 46. In a particular embodiment, the radius 164 on the drive shaft 46 is large enough to reduce the stress concentration from the loading of the movable scroll compressor body 112 against the drive pin 74.

Further, the chamfered end portion 162 includes at least one notched opening 163. In the embodiment shown, the slider block 150 has two notched openings 163, but, in alternate embodiments, may have fewer or greater than two such openings. The notched openings 163 act as vents that allow refrigerant gas that is trapped in the compressor oil to escape. Trapped refrigerant gas can dilute the oil degrading the quality of the oil that is lubricating the bearing surfaces. It is also possible that, during operation of the scroll compressor assembly 10, a volume of the trapped refrigerant gas can become pressurized, and, in this case, move the slider block 150 upward within the movable scroll body cylindrical bushing drive hub 128.

In the embodiment of FIGS. 11A and 11B, the interior surface 153 has two rounded portions 157, a first flat portion 154, and a second flat portion 155. In particular embodiments, the first flat portion 154 is longer than the second flat portion 155. In more particular embodiments, the first flat portion 154 is spaced approximately 180 degrees apart from the second flat portion 155 such the surfaces of the two flat portions 154, 155 are substantially parallel.

As can be seen from the end view in FIG. 10A, when the slider block 150 is assembled over the drive pin 74, the longer first flat portion 154 is abuts a similarly flat portion 156 of the drive pin 74. The short second flat portion 155 functions to keep the slider block 150 in the correct position with respect to the drive pin 74, that is, with the longer first flat portion 154 in contact with the drive pin flat portion 156. It can also be seen that the flat portion 156 of the drive pin 74 has a raised section, relative to other exterior surface portions of the drive pin 74 that comprises a drive surface 158. In particular embodiments, the length of the raised drive surface 158 is shorter than the overall drive pin 74 length. In more particular embodiments, the length of drive surface 158 is approximately 25% to 50% of the overall drive pin 74 length. Further, in certain embodiments, the drive surface 158 is a plateau that may be rectangular and relatively flat, though other configurations of the drive surface 158 are envisioned.

Figure 11C:
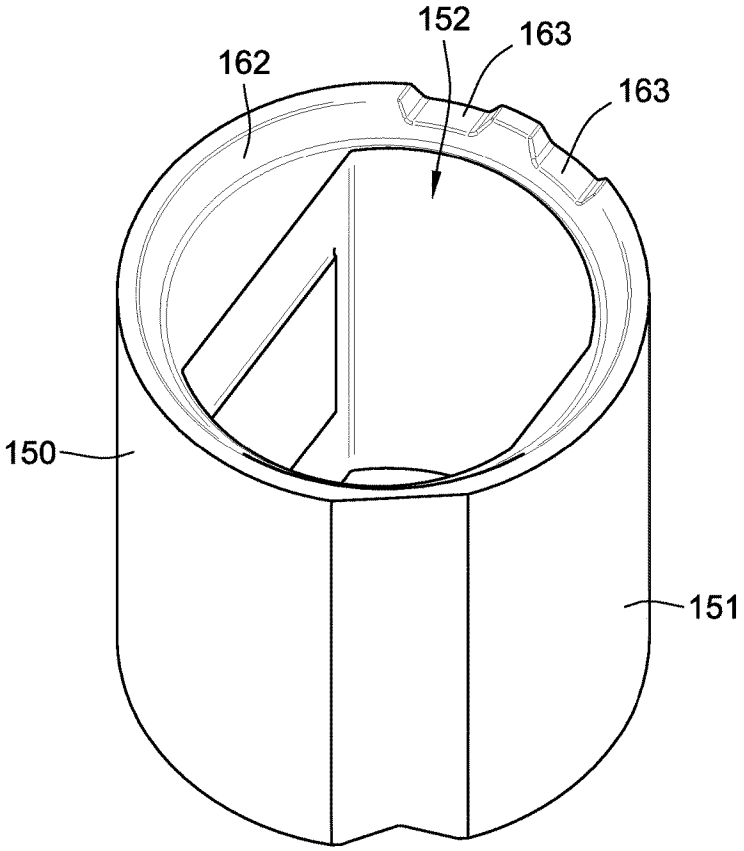

One of ordinary skill in the art will recognize that, in alternate embodiments of the invention, the shorter raised plateau-like drive surface could be located on a drive surface on the inner periphery of the slider block 150 to perform the same function, i.e., to provide radial compliance for the movable scroll body 122. FIG. 11C provides a perspective view illustrating this raised plateau-like surface on the slider block 150. Additionally, one skilled in the art will recognize that the drawings provided herewith are sufficient to demonstrate that the concept of a raised drive surface to provide improved radial compliance can be applied to the slider block 150 as well as the drive pin 74.

Figure 12:
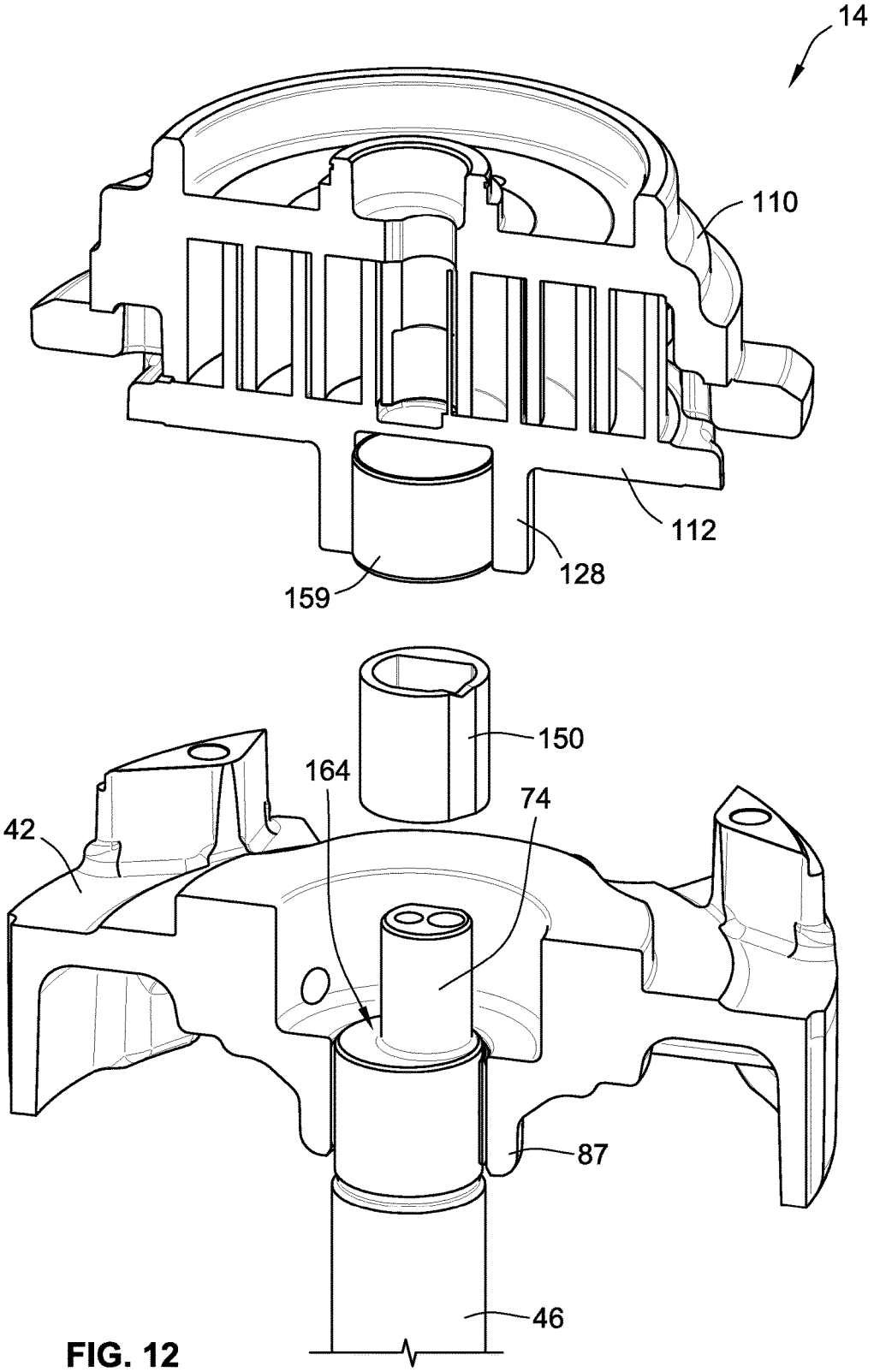
FIG. 12 is an exploded, cross-sectional, isometric view of a portion of a scroll compressor showing a slider block, according to an embodiment of the invention; and While the invention will be described in connection with certain preferred embodiments, there is no intent to limit it to those embodiments. On the contrary, the intent is to cover all alternatives, modifications and equivalents as included within the spirit and scope of the invention as defined by the appended claims.

We now refer to FIG. 12 which shows an exploded, cross-sectional, isometric view of a portion of a scroll compressor 14 incorporating the slider block 150, according to an embodiment of the invention, and again to FIG. 4 which shows a cross-sectional, isometric view of a top portion of the scroll compressor assembly 10. As shown, the drive shaft 46 is located within the central bearing hub 87 of crankcase 42. The eccentric drive pin 74 is shown at the end of the drive shaft 46. The slider block 150 is assembled to the drive pin 74 in the manner shown in FIG. 10. In certain embodiments, a sleeve 159 is installed in the cylindrical bushing drive hub 128 such that the sleeve 159 is disposed between the slider block 150 and the cylindrical bushing drive hub 128 of the movable scroll compressor body 112. In a particular embodiment, the sleeve 159 is press-fit into the cylindrical bushing drive hub 128. In a more particular embodiment, the sleeve 159 has a polymer lining on its interior surface that abuts the exterior surface 151 of the slider block 150.

In the operation of a conventional scroll compressor, if the drive pin is deflected or bowed under load so that the drive surface is at an angle to a longitudinal axis of the scroll compressor assembly, the drive bearing or slider block is also tilted and the load is transferred to a lower edge of the drive pin (i.e., to the right in the side view of FIG. 10B). This often leads to high local loading and increased bearing wear or failure.

However, embodiments of the present invention address this problem by limiting the drive surface 158 to a shorter length. As shown in FIG. 10, embodiments of the invention introduce a drive surface 158 of relatively small area which allows for tilting of the slider block 150 under conditions of load deflections. This allows the slider block 150, which acts as the drive bearing, to remain properly aligned even when shaft deflections are present. In the embodiment shown, the slider block 150 will tend to tilt or rock about the limits of the drive surface 158 if the drive pin 74 is deflected. The drive surface 158 itself will tend to be edge loaded, but Hertzian contact deflections will tend to generate a larger contact surface and wear will be reduced. If any wear does take place, it will tend to increase the contact area which will reduce the contact stress until it is at an acceptable level for reduced, or no, continued wear.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor comprising:

a housing;

a drive shaft;

an eccentric drive pin;

scroll compressor bodies disposed in the housing, the scroll bodies including a first scroll body and a second scroll body, the first and second scroll bodies having respective bases and respective scroll ribs that project from the respective bases, wherein the scroll ribs mutually engage, the second scroll body being movable relative to the first scroll body for compressing fluid;

a drive unit configured to rotate the drive shaft to drive the second scroll body in an orbital path, the drive shaft having the eccentric drive pin configured to engage a drive hub on the second scroll body; and a slider block that fits over the drive pin and provides radial compliance of the second scroll body, the slider block having a first drive surface configured to engage a second drive surface of the eccentric drive pin, wherein the first drive surface is substantially flat, and wherein the second drive surface is substantially flat and raised with respect to an exterior surface portion of the drive pin, the second drive surface having a length that is shorter than the overall length of the eccentric drive pin, such that the slider block tilts about one or more edges of the second drive surface when the drive shaft is deflected under load.

2. The scroll compressor of claim 1, wherein the length of the second drive surface is 25% to 50% of the overall drive pin length.

3. The scroll compressor of claim 1, wherein the second drive surface is generally rectangular.

4. The scroll compressor of claim 1, wherein the slider block includes a cylindrical exterior surface and an opening defined by an interior surface, the interior surface having two rounded portions and two flat portions.

5. The scroll compressor of claim 4, wherein the two flat portions are both rectangular and comprise a first flat portion and a second flat portion, wherein the first flat portion has a length equal to that of the second flat portion, the first flat portion being wider than the second flat portion.

6. The scroll compressor of claim 5, wherein the first flat portion abuts a flat portion of the drive pin.

7. The scroll compressor of claim 5, wherein the second flat portion functions to locate the slider block in a set position with respect to the drive pin.

8. The scroll compressor of claim 1, wherein the slider block includes a chamfered surface extending axially from one end of the slider block, wherein axially means along a longitudinal axis of the drive shaft, the chamfered surface having one or more notched openings to prevent the trapping of gas between the slider block and the shaft.

9. The scroll compressor of claim 1, wherein the second drive surface is located on a central portion of the drive pin with respect to the overall length of the drive pin, wherein the second drive surface is on the exterior surface portion of the drive pin and between opposed ends of the drive pin.

10. The scroll compressor of claim 9, wherein portions of the drive pin on either side of the central portion are not raised.

11. A method of providing radial compliance for the second scroll body in a scroll compressor, the method comprising:

configuring a slider block to assemble onto a drive pin eccentrically located at one end of a drive shaft, the drive pin having an exterior drive surface that is substantially flat and raised with respect to an exterior surface of the drive pin to engage a substantially flat drive surface of the slider block, wherein the exterior raised drive surface has a shorter length than the overall length of the drive pin such that the slider block tilts back and forth on respective edges of the exterior raised drive surface where the edges engage the slider block;

assembling the slider block onto the drive pin; and assembling a movable scroll member onto the slider block, the movable scroll member having a cylindrical hub configured to receive the slider block.

12. The method of claim 11, wherein the length of the exterior raised drive surface is between 25% and 50% of the overall drive pin length.

13. The method of claim 11, wherein the exterior drive surface is generally rectangular.

14. The method of claim 11, wherein assembling the slider block to the drive pin comprises assembling a first flat portion of an interior surface of the slider block to a corresponding flat portion of the drive pin.

15. The method of claim 14, wherein assembling the slider block to the drive pin further comprises assembling the slider block having a second flat portion configured to locate the slider block in a set position with respect to the drive pin.

16. The method of claim 11, further comprising assembling a sleeve between the slider block and the cylindrical hub of the movable scroll member.

17. The method of claim 11, wherein assembling the slider block to the drive pin comprises assembling the slider block having a cylindrical exterior surface.

18. The method of claim 17, wherein assembling the slider block to the drive pin comprises assembling the slider block having a chamfered surface extending axially from one end of the slider block, the chamfered surface having one or more notched openings to prevent the trapping of gas beneath the slider block.

19. A scroll compressor comprising:

a housing;

a drive shaft;

an eccentric drive pin;

scroll compressor bodies disposed in the housing, the scroll bodies including a first scroll body and a second scroll body, the first scroll body and the second scroll body having respective bases and respective scroll ribs that project from the respective bases, wherein the scroll ribs mutually engage, the second scroll body being movable relative to the first scroll body for compressing fluid;

a drive unit configured to rotate the drive shaft to drive the second scroll body in an orbital path, the drive shaft having the eccentric drive pin configured to engage a drive hub on the second scroll body; and a slider block that fits over the eccentric drive pin and provides radial compliance of the second scroll body, the slider block having a first drive surface that is substantially flat and raised with respect to the generally smooth interior surface of the slider block to engage a second drive surface of the drive pin, wherein the second drive surface is substantially flat, the first drive surface having a length that is shorter than the overall length of the eccentric drive pin, such that the slider block tilts about one or more edges of the first drive surface when the drive shaft is deflected under load;

wherein the slider block includes a cylindrical exterior surface and an opening defined by a generally smooth interior surface, the generally smooth interior surface having two rounded portions and two at least partially flat portions, and wherein the first drive surface is located on a central portion of one of the two at least partially flat portions.

20. The scroll compressor of claim 19, wherein the length of the first drive surface is 25% to 75% of the overall slider block length.

21. The scroll compressor of claim 19, wherein the two at least partially flat portions are both rectangular and comprise a first flat portion and a second flat portion, wherein the first flat portion has a length equal to that of the second flat portion, the first flat portion being wider than the second flat portion.

* * * * *